United States Patent [19]

Johnston et al.

[11] 4,343,485

[45] Aug. 10, 1982

[54] REVERSE CAMBER SKI

[75] Inventors: Norman H. Johnston; David A. Johnston, both of Valparaiso, Ind.

[73] Assignee: Ski World, Inc., Indianapolis, Ind.

[21] Appl. No.: 213,012

[22] Filed: Dec. 4, 1980

Related U.S. Application Data

[63] Continuation of Ser. No. 18,800, Mar. 8, 1979, abandoned.

[51] Int. Cl.[3] ..... A63C 5/00

[52] U.S. Cl. ..... 280/609

[58] Field of Search ..... 280/609, 601, 600, 610

[56] References Cited

U.S. PATENT DOCUMENTS

| | | | |
|---|---|---|---|
| 1,723,693 | 8/1929 | Froholm | 280/608 |
| 2,055,757 | 9/1936 | Tolman | 280/609 |
| 2,510,794 | 6/1950 | Beerli | 280/609 |
| 2,920,897 | 1/1960 | Jensen | 280/11.12 |
| 3,212,787 | 10/1965 | Werntz | 280/609 |
| 3,724,866 | 4/1973 | Kaplan | 280/607 |
| 3,907,315 | 9/1975 | Charneck | 280/609 |
| 4,007,946 | 2/1977 | Sarver | 280/600 |
| 4,085,947 | 4/1978 | Sarver | 280/609 |

FOREIGN PATENT DOCUMENTS

| | | | |
|---|---|---|---|
| 82921 | 2/1921 | Austria | 280/608 |
| 572337 | 3/1959 | Canada | 280/610 |
| 285338 | 4/1913 | Fed. Rep. of Germany | 280/600 |
| 1132474 | 6/1962 | Fed. Rep. of Germany | 280/609 |
| 373494 | 1/1907 | France | 280/609 |
| 924836 | 4/1947 | France | 280/601 |
| 1248744 | 11/1960 | France | 280/600 |

OTHER PUBLICATIONS

"Barrel Stave Skis," *How to Make It Book of Crafts,* Austin Sprague, Published 1941, p. 172.

*Primary Examiner*—David M. Mitchell

*Attorney, Agent, or Firm*—Allegretti, Newitt, Witcoff & McAndrews, Ltd.

[57] ABSTRACT

An improved ski has a reverse camber bottom surface and an hourglass shaped side camber. The waist of the hourglass side camber configuration and the bindings are positioned slightly back from the usual ski binding placement position.

6 Claims, 2 Drawing Figures

REVERSE CAMBER SKI

This is a continuation of application Ser. No. 18,800, filed Mar. 8, 1979 and now abandoned.

BACKGROUND OF THE INVENTION

This invention relates to an improved ski design and more particularly to a ski design with a reverse camber bottom surface.

It is reported that the first skis were made of barrel staves. Because of the lateral and longitudinal curvature of the staves, skiers had difficulty controlling direction of ski movement and turns. Subsequently, ski poles were developed which the skier could use to place in the ground and thereby steer himself.

Skis were then developed with a groove along the middle of the bottom of the ski to improve ski stability and permit the skier to ski in a straight line. Skis of this type were generally flat. Later, skis were constructed with a bottom surface that bowed slightly upward at the center. This structure provided improved ski stability. The upwardly bowed shape of the bottom ski surface is termed "camber". Clement, U.S. Pat. No. 2,258,046, issued Oct. 7, 1941 for a Ski, illustrates an early ski which incorporates camber.

Subsequently it was discovered that by making the forward end and rear end of the ski wider than the center or waist of the ski, ski stability and ease of turning would improve. Beerli, in U.S. Pat. No. 2,510,794 issued June 6, 1950, illustrates this concept which is termed "side camber". In recent years improved materials have been used for the manufacture of skis to provide improved stability and consistency in skis. Other related developments in the art of skis are represented by U.S. Pat. No. 3,212,787 issued Oct. 19, 1965 to L. R. Werntz for a Snow Ski For Making Fast Turns. This patent illustrates a ski which has a flat surface with vertical, downwardly projecting blades running from a position beneath the ski boot binding to the rear end of the ski. The front of the ski is elevated with respect to the horizontal surface at the rear half of the ski.

Sarver U.S. Pat. No. 4,085,947 and Sarver U.S. Pat. No. 4,007,946 both teach a raised or elevated planar section forward of the binding. Both of these patents, however, also teach a ski which has a very short trailing edge at the rear of the ski binding.

Despite the numerous improvements in ski design, skiing remained difficult to learn for many. To overcome this difficulty, a new learning technique was developed known as the graduated length method (GLM). This method to teach skiing starts by providing short skis, approximately 3' long, for the beginning skier. As the skier becomes more and more proficient, he graduates to a longer and longer ski until ultimately the traditional ski, which is about 6' long, is mastered by the student.

Although the graduated length method has proven to be an excellent teaching tool, the short ski used in the teaching method created an uneven pattern of closely spaced moguls or valleys and hillocks on a ski slope which would interfere with the safe and efficient operation of normally sized skis. Normal skis, which are longer and more flexible than the short skis, often break or dig into snowbanks when used on a slope with moguls created by GLM skis. Therefore, the need for a long instructional ski has been sought. Such a ski would be useful in teaching the beginning skier, yet it would not create an undesirable pattern of moguls on a ski slope.

SUMMARY OF THE INVENTION

Briefly, the present invention comprises a ski, preferably in the range of 120 cm. to 180 cm. in length, having a generally planar bottom surface. The bottom surface has at least a partial reverse camber in the longitudinal direction. The side edges of the ski employ side camber. The bindings and waist of the ski are moved rearwardly of the center of the ski. Preferably the bottom surface has no grooves or slats and is planar in the transverse direction.

It is thus an object of the present invention to provide an improved ski which employs reverse camber.

Another object of the present invention is to provide an improved ski which incorporates a combination of reverse camber, side camber, and rearward placement of bindings.

Still a further object of the present invention is to provide a reverse camber ski of improved stability which may be used advantageously as a full size ski for purposes of ski instruction.

Another object of the present invention is to provide an improved ski with reverse camber which has improved stability for turns and for parallel skiing and which is appealing for use by beginning skiers as well as expert skiers.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
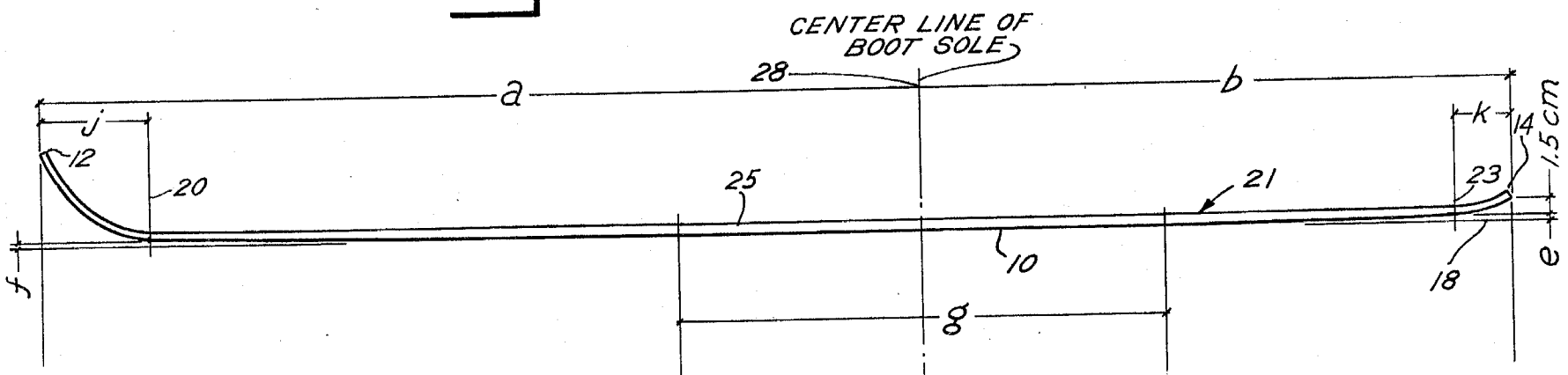
FIG. 1 is a side plan view of the improved ski of the present invention.

Referring to the figures, the improved ski of the present invention preferably has a length between 120 cm. and 180 cm. although it is possible to incorporate the design in a shorter ski or longer ski. The preferable length is at least 150 cm. thereby eliminating use of shorter skis on ski slopes since the shorter skis tend to dig undesirable moguls. Skis which are 120 cm. to 140 cm. in length are primarily for use by children. Thus they are lighter and more flexible generally. The longer skis are designed for adults and are generally stiffer and of heavier construction. Special purpose ballet skis can also incorporate the invention. Ballet skis for adults are generally shorter (140 cm.).

The ski illustrated in the figures is measured from the extreme forward end of a tip 12 to a rear end 14 along a planar bottom surface 10. The tip 12 is turned upward in typical fashion for skis and is smoothly joined with the main body 21 of the ski along an imaginary line 20. Likewise, end 14 may be turned upward from imaginary line 23.

The ski employs reverse camber for the planar bottom surface 10. That is, bottom surface 10, which extends from line 20 to line 23, is substantially flat in a direction transverse to a longitudinal axis 16 of the ski, i.e. the ski bottom surface 10 has substantially no or very little curvature in the lateral direction. However, the ski is curved in the longitudinal direction and the curvature employed is opposite the curvature normally provided in skis. In other words, instead of having "camber", the ski was "reverse camber38 .

If the ski is positioned on a horizontal surface 18 as shown in FIG. 1, the line 20 and line 23 will both be spaced from the surface 18 and the middle section 25 of the ski will be tangent to surface 18. That portion of the ski from the front line 20 to the back line 23 has a reverse camber which is either a compound, arcuate curve or a combination of a flat middle section 25 and connected curved sections on either side. Thus, the bottom surface 10 may or may not include a flat middle section 25. If middle section 25 is curved, it is a reverse camber curve. A midpoint 28 of the ski rests on the horizontal surface 18.

Figure 2:
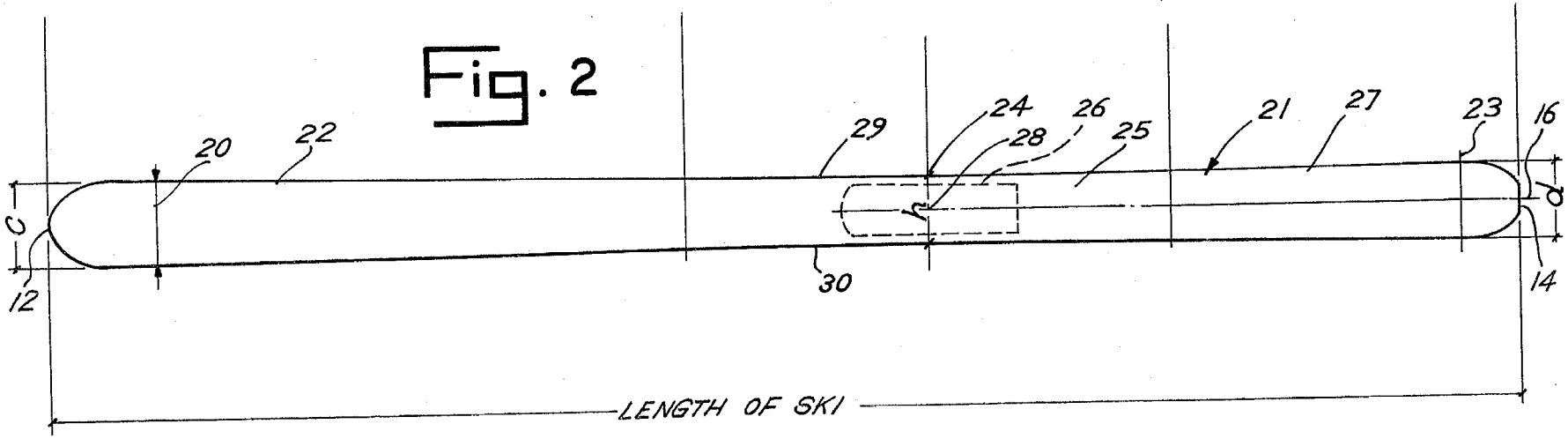
FIG. 2 is a top plan view of the ski of FIG. 1.

The ski also employs the concept of side camber. That is, referring to FIG. 2, forward end 22 of the ski is wider than a mid-portion or waist 24. The rear end 27 is likewise wider than the waist 24.

The position of a ski boot sole 26 is shown in phantom on the ski. Midpoint 28 of sole 26 corresponds with the narrowest dimension or waist 24 of the ski. The midpoint 28 is slightly to the rear of the center of the ski and slightly to the rear of the normal position that the sole 26 would be positioned, by means of bindings (not shown), on a ski. The sole 26 is also termed the binding section and the sole midpoint is the same as the binding section midpoint. The midpoint 28 for the improved ski of the present invention is not at the longitudinal center of the ski. Midpoint 28 is rearward of the longitudinal center and coincides with the midpoint of sole 26 or bindings section and the narrow side dimension or waist 24.

The following chart sets forth specific dimensions in centimeters of various length skis incorporating the invention along with recommended tolerances:

these dimensional characteristics and still practice the present invention. The features of the present invention, which are adjustable, include the curvature of the reverse camber associated with the bottom planar surface 10, the side camber associated with sides 29 and 30, and the position of the midpoint 28.

In general, reverse camber is a requirement of the invention, particularly in combination with side camber wherein the front end or forward section 22 is somewhat wider than the rear end section 27. Importantly, the waist 24 and center point 28 should preferably coincide and are positioned to the rear of the actual midpoint of the ski. This is unconventional positioning. Of course, it is important not to place the midpoint 28 too far to the rear.

Note that specific examples of the invention have been set forth as the best known modes of practicing the invention. It is possible to depart from the examples, while still practicing the invention. For example, longer skis can be made to incorporate the invention. Longer skis are useful in "powder" snow conditions. Generally, longer skis require less reverse camber to practice the invention. Also, the bottom ski surface 10 may be made slightly concave or convex in the transverse direction. Or the bottom surface 10 may include one or more grooves or slots.

Thus, while there has been set forth a preferred embodiment of the invention, it is to be understood that the invention is to be limited only by the following claims and their equivalents.

What is claimed is:

1. An improved snow ski especially useful for instruction and for use by beginning skiers to make conventional turns and for parallel skiing, said ski comprising, in combination:

an elongate ski member at least 120 cm. long having a tip, a bottom surface, a rear end, a binding section

SCHEDULE OF DIMENSIONS

| Length of Ski | a±10cm. | b±10cm. | c±1.0cm. | d±1.0cm. | e±0.5cm. | f±0.5cm. | g±10cm. | h±1cm. | j±2cm. | k±1cm. | $\frac{a-j}{b-k}$ | $\frac{a}{b}$ |
|---|---|---|---|---|---|---|---|---|---|---|---|---|
| 180cm. | 105.0cm. | 75.0cm. | 8.8cm. | 8.0cm. | .250cm. | .250cm. | 100cm. | 6.9cm. | 15cm. | 5cm. | 1.29 | 1.40 |
| 170 | 100.0 | 70.0 | 8.8 | 8.0 | .375 | .375 | 90 | 6.9 | 15 | 5 | 1.31 | 1.43 |
| 160 | 95.0 | 65.0 | 8.8 | 8.0 | .375 | .375 | 70 | 6.9 | 15 | 5 | 1.33 | 1.46 |
| 150 | 90.0 | 60.0 | 8.8 | 8.0 | .500 | .500 | 50 | 6.9 | 15 | 5 | 1.36 | 1.50 |
| 140 | 85.0 | 55.0 | 8.0 | 7.4 | .375 | .375 | 50 | 6.5 | 14 | 5 | 1.40 | 1.54 |
| 130 | 82.5 | 47.5 | 8.0 | 7.4 | .375 | .375 | 45 | 6.5 | 14 | 5 | 1.59 | 1.74 |
| 120 | 77.5 | 42.5 | 8.0 | 7.4 | .375 | .375 | 45 | 6.5 | 14 | 5 | 1.67 | 1.82 |

| length (cm) | c/length | d/length | h/length |
|---|---|---|---|
| 180 | 0.049 ± 0.005 | 0.045 ± 0.005 | 0.038 ± 0.005 |
| 170 | 0.052 ± 0.005 | 0.047 ± 0.005 | 0.041 ± 0.005 |
| 160 | 0.055 ± 0.005 | 0.050 ± 0.005 | 0.043 ± 0.005 |
| 150 | 0.059 ± 0.006 | 0.054 ± 0.005 | 0.046 ± 0.005 |
| 140 | 0.057 ± 0.006 | 0.053 ± 0.005 | 0.046 ± 0.005 |
| 130 | 0.062 ± 0.007 | 0.057 ± 0.005 | 0.050 ± 0.006 |
| 120 | 0.067 ± 0.008 | 0.062 ± 0.005 | 0.054 ± 0.006 |

The curvature of the bottom planar surface 10 of the ski is a smooth uniform curve having a reverse camber shape in accordance with the dimensional characteristics described above. Note that the length of the middle section 25(*g*) may be varied ±20 cm. Also, middle section 25 may be generally planar or a very shallow reverse camber curve. Also, the midpoint of section 25 corresponds with midpoint 28. Also the ratio of the portion of the ski forward the midpoint or waist to the portion rearward from the midpoint 28 or waist 24 is preferably in the range of 1.25 to 2.00 with preferred dimensions set forth above. It is possible to vary from for receipt of a boot sole, sides, and means for improved stability in turns and in parallel skiing;

said means for improved stability including said bottom surface having a curved, smooth surfaced, reverse camber configuration extending from adjacent the tip to adjacent the rear end, said bottom surface substantially continuous, uninterrupted, substantially flat and planar in the transverse direction and defining a compound curve in the longitudinal direction with the bottom surface between the tip and a middle waist portion and the bottom surface between the rear end and the middle waist portion of the ski both elevated above the middle waist portion when the ski is in a horizontal plane to define a reverse camber, the sides having a side camber configuration with a waist substantially coincident with the middle waist portion intermediate the tip and rear end; the opposite sides being spaced a greater distance near the tip and rear end than at the waist; the ratio of maximum ski width to maximum ski length being less than 0.075 and decreasing toward the waist; the binding section having a center substantially coincident with the waist and middle waist portion; and the ratio of the length of the ski forward of the waist to the length of the ski rearward of the waist in the range of 1.25 to 2.00.

2. The improved ski of claim 1 wherein the ratio of the length of the ski forward of the waist to the length rearward of the waist in the range of 1.35 to 1.60.

3. The improved ski of claim 1 wherein said ratio of ski width to ski length is in the range of 0.038 to 0.066.

4. The improved ski of claim 1 wherein the ratio of the width of the tip of the length is in the range of 0.044 to 0.075, the ratio of the width of the rear end to th elength is in the range of 0.040 to 0.067 and the ratio of the width of the waist to the length is in the range of 0.038 to 0.060 as the length varies from 180 cm. to 120 cm.

5. The improved ski of claim 1 wherein said reverse camber is defined by a compound curve of the ski which defines a distance between a horizontal plane and the bottom surface of the ski in the range of 0.250 cm. to 0.500 cm. on either side of the midpoint of the binding section at a distance substantially in the range of 40 cm. to 110 cm. from said center of said binding section.

6. An improved reverse camber ski designed to make conventional turns and for parallel skiing comprising, in combination:

an elongated ski member at least 120 cm. long having a tip, a generally planar bottom surface, a rear end, a binding section for receipt of a boot sole, and sides, said bottom surface having a curved reverse bottom camber configuration extending from adjacent the tip to adjacent the rear end with the low point of the curve at the position for the boot sole when the ski member is in the horizontal position, said bottom surface being substantially continuous, uninterrupted and flat and planar in the transverse direction, said reverse bottom camber defining a compound curve in the longitudinal direction, the sides having a side camber configuration with a waist intermediate the tip and rear end, the waist being positioned substantially at the position for the boot sole with the opposite sides of the ski spaced a greater distance near the tip and rear end of the ski than at the waist, said ski including means for maintaining parallel tracking and stability of a pair of skis in a turn with the skier in boots at the position of the boot sole, said means including a combination of reverse bottom camber, side camber and waist position in each ski, with the ratio of the length of the ski forward of the waist to the length of the ski rearward of the waist in the range of 1.25 to 2.00 and the reverse camber is defined by a compound curve of the ski which defines a distance between a horizontal plane and the bottom surface of the ski in the range of 0.250 cm. to 0.500 cm. on each side of the midpoint of the binding section at a distance in the range of 40 cm. to 110 cm. from said center of said binding section.

* * * * *